US005783375A

United States Patent [19]

Twist

[11] Patent Number: 5,783,375

[45] Date of Patent: Jul. 21, 1998

[54] METHOD OF PROCESSING A COLOR PHOTOGRAPHIC SILVER HALIDE MATERIAL

[75] Inventor: Peter Jeffery Twist, Great Missenden, United Kingdom

[73] Assignee: Eastman Kodak Company, Rochester, N.Y.

[21] Appl. No.: 705,474

[22] Filed: Aug. 29, 1996

[30] Foreign Application Priority Data

Sep. 2, 1995 [GB] United Kingdom ..... 9517895

[51] Int. Cl.[6] ..... G03C 7/42

[52] U.S. Cl. ..... 430/414; 430/373; 430/393; 430/418; 430/430; 430/460; 430/461; 430/943

[58] Field of Search ..... 430/373, 393, 430/414, 418, 460, 461, 943

[56] References Cited

U.S. PATENT DOCUMENTS

| | | | |
|---|---|---|---|
| 4,045,225 | 8/1977 | Shimamura et al. | 430/373 |
| 5,387,499 | 2/1995 | Earle et al. | 430/414 |
| 5,445,925 | 8/1995 | Marsden et al. | 430/414 |

*Primary Examiner*—Hoa Van Le
*Attorney, Agent, or Firm*—J. Lanny Tucker

[57] ABSTRACT

A redox amplification process with minimal steps includes processing a silver halide with an amplifier/bleach/fix solution that includes a redox oxidant capable of bleaching a silver image and a fixing agent that does not react with the redox oxidant.

16 Claims, No Drawings

METHOD OF PROCESSING A COLOR PHOTOGRAPHIC SILVER HALIDE MATERIAL

FIELD OF THE INVENTION

This invention relates to a method of processing a color photographic silver halide material and, in particular, a process in which a dye image is formed by a redox amplification process.

BACKGROUND OF THE INVENTION

Redox amplification processes have been described, for example in British Specification No. 1,268,126, U.S. Pat. No. 3,748,138, U.S. Pat. No. 3,822,129 and U.S. Pat. No. 4,097,278. In such processes color materials are developed to produce a silver image (which may contain only small amounts of silver) and then treated with a redox amplifying solution (or a combined developer-amplifier) to form a dye image. Image amplification takes place in the presence of the silver image that acts as a catalyst.

Oxidized color developer reacts with a color coupler to form the image dye. The amount of dye formed depends on the time of treatment or the availability of color coupler and is less dependent on the amount of silver in the image as is the case in conventional color development processes.

Examples of suitable oxidizing agents include peroxy compounds including hydrogen peroxide and compounds that provide hydrogen peroxide, e.g., addition compounds of hydrogen peroxide; cobalt (III) complexes including cobalt hexammine complexes; and periodates. Mixtures of such compounds can also be used.

When the silver coverage of the photographic material is very low, it is possible to avoid bleaching and/or fixing steps. However when the silver level is not quite so low, the developed silver image is just noticeable and is better removed together with any undeveloped silver halide. As with conventional processes this requires a bleach and fix or a combined bleach-fix processing step.

When it is desired to bleach and fix the photographic material after redox amplification dye image formation it is necessary to have one or two extra processing steps. It is the object of the present invention to provide a process with a reduced number of processing baths.

SUMMARY OF THE INVENTION

According to the present invention there is provided a method for processing comprising:

A) color developing a photographic silver halide color material comprising two or more silver halide layers sensitized to different regions of the visible spectrum having associated therewith appropriate dye image forming couplers, and B) treating the color developed material with an amplifier/bleach/fix solution comprising:

a redox oxidant that is capable of bleaching a silver image, and a fixing agent that does not poison the catalytic properties of the silver image, and that does not react with the redox oxidant.

A redox amplification process may be performed including bleach and fix steps with the minimum number of processing baths.

DETAILED DESCRIPTION OF THE INVENTION

The color developer solution useful in this invention may contain any of the following color developing agents:

4-amino-3-methyl-N,N-diethylaniline hydrochloride, 4-amino-3-methyl-N-ethyl-N-b-(methanesulfonamido)-ethylaniline sulfate hydrate, 4-amino-3-methyl-N-ethyl-N-b-hydroxyethylaniline sulfate, 4-amino-3-b-(methanesulfonamido)ethyl-N,N-diethylaniline hydrochloride, 4-amino-N-ethyl-N-(2-methoxy-ethyl)-m-toluidine di-p-toluene sulfonate, and, especially, 4-N-ethyl-N-(b-methanesulfonamidoethyl)-o-toluidine sesquisulfate (CD3).

The color developer solution may also contain compounds that increase its stability, for example, hydroxylamine, diethylhydroxylamine, substituted hydroxylamine derivatives, and/or a long chain compound that can adsorb to silver, e.g., dodecylamine. Such long chain compounds can also be present in the amplification/bleach/fix solution.

The redox amplifier/bleach/fix solution contains a redox oxidant, for example, hydrogen peroxide or a compound that yields hydrogen peroxide. It may contain from 0.1 to 150, preferably 10 to 50 ml/l, hydrogen peroxide 30% w/w solution.

The pH of the amplifier/bleach/fix solution may be in the range 6 to 11. Preferably the pH is in the range 8 to 10. It can be buffered.

The redox amplifier/bleach/fix solution also contains a fixing agent that does not poison the catalytic properties of the silver image. Such compounds include polycarboxylic or polyphosphonic amino acids. The preferred fixing agents include compounds having at least one:

$$N-[(CH_2)_n-A]_p$$

moiety wherein A is —COOH or —$PO_3H_2$ and n is 1 to 6 and p is 1 to 3 provided that the compound contains at least 2 A groups.

Examples of such compounds include, but are not limited to:

ethylenediaminetetraacetic acid (EDTA), propylenediaminetetraacetic acid, 2-hydroxy-1,3-propylenediaminetetraacetic acid, diethylenetriaminepentaacetic acid, nitrilotriacetic acid, ethylenediaminetetramethylene phosphonic acid, diethylenetriaminepentamethylene phosphonic acid, cyclohexylenediaminetetraacetic acid,

[(Ethylenedioxy)diethylenedinitrilo] tetra acetic acid, and ethylenedinitrilo-N,N'-bis(2-hydroxybenzyl)-N,N'-diacetic acid The amplifier/bleach/fix solution can also contain a fixing accelerator, such as an alkanolamine or a dithioalkane diol.

The fixing accelerator should not inhibit redox image amplification or react with hydrogen peroxide. They may be chosen from among known fixing accelerators by testing them to see if they inhibit the redox image amplification or react with hydrogen peroxide.

Examples of fixing accelerators are:

primary, secondary, tertiary alkylamines (for example, ethylamine, propylamine, diethylamine, triethylamine or cyclohexylamine), alkyl diamines (for example, ethylene diamine, propylene diamine or cyclohexyl diamine), alkyl triamines, tetramines, pentamines, hexamines (for example, diethylene triamine, triethylene tetramine), cyclic polyamines (for example, hexamethylene tetramine), aryl amines (for example, benzyl amine), mono, di, tri-alkanolamines (for example, ethanolamine, propanolamine, diethanolamine,or dipropanolamine), thioethers (for example, dithiaoctane diol), thioamines, and morpholine.

The fixing agents can be present in amounts in the range from 0.5 to 150 g/l, preferably from 10 to 100 g/l, and especially from 40 to 60 g/l. The effectiveness of the fixing accelerator varies considerably, but typically they may be present in amounts in the range from 0.01 to 150 g/l, and preferably from 0.1 to 80 g/l .

The amplifier/bleach/fix step may be followed by a wash step.

A particular application of this technology is in the processing of silver chloride color paper, for example, a color paper comprising an emulsion having at least 85 mol % silver chloride, and especially such a color paper with low silver levels, for example, total silver levels below 130 $mg/m^2$, e.g., from 25 to 120 $mg/m^2$, preferably below 70 $mg/m^2$ and particularly in the range 20 to 70 $mg/m^2$. Within these total ranges the blue sensitive silver halide emulsion layer unit may comprise 20 to 60 $mg/m^2$, preferably 25 to 50 $mg/m^2$ with the remaining silver divided between the red and green-sensitive silver halide emulsion layer units, preferably more or less equally between the red and green-sensitive silver halide emulsion layer units.

The photographic materials can be two color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

Suitable materials for use in the emulsions and elements processed by the method of this invention, are described in Research Disclosure Item 36544, September 1994, published by Kenneth Mason Publications, Emsworth, Hants, United Kingdom.

The present processing method is preferably carried out by passing the material to be processed through a tank containing the processing solution that is recirculated through the tank at a rate of from 0.1 to 10 tank volumes per minute. Such a tank is often called a low volume thin tank or LVTT for short.

The preferred recirculation rate is from 0.5 to 8, especially from 1 to 5, and particularly from 2 to 4 tank volumes per minute.

The recirculation, with or without replenishment, is carried out continuously or intermittently. In one method of working, both recirculation and replenishment could be carried out continuously while processing was in progress but not at all or intermittently when the machine was idle. Replenishment may be carried out by introducing the required amount of replenisher into the recirculation stream either inside or outside the processing tank.

It is advantageous to use a tank of relatively small volume. Hence in a preferred embodiment of the present invention, the ratio of tank volume to maximum area of material accommodatable therein (i.e., maximum path length×width of material) is less than 11 $dm^3/m^2$, and preferably less than 3 $dm^3/m^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution less than 11 mm, preferably less than 5 mm and especially about 2 mm. The shape of the tank is not critical but it could be in the shape of a shallow tray or, preferably U-shaped. It is preferred that the dimensions of the tank be chosen so that the width of the tank is the same or only just wider than the width of the material to be processed.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$0.6 \leqq F/A \leqq 23$$

wherein:

F is the flow rate of the solution through the nozzle in liters/minute; and

A is the cross-sectional area of the nozzle provided in square centimeters.

Providing a nozzle in accordance with the foregoing relationship assures appropriate discharge of the processing solution against the photosensitive material. Such Low Volume Thin Tank systems are described in more detail in the following patent specifications: U.S. Pat. No. 5,294,956, U.S. Pat. No. 5,179,404, U.S. Pat. No. 5,270,762, EP-A-559,025, EP-A-559,026, EP-A-559,027, WO 92/10790, WO 92/17819, WO 93/04404, WO 92/17370, WO 91/19226, WO 91/12567, WO 92/07302, WO 93/00612, WO 92/07301, WO 92/09932 and U.S. Pat. No. 5,436,118.

The following Examples are included for a better understanding of the invention and to provide experimental evidence that demonstrates the phenomena involved.

EXAMPLE 1

In this example experiments are carried out to establish a fixer formulation in which the fixing agent does not poison the catalytic properties of the silver image and which does not react with the redox oxidant A developer solution of the following composition was prepared.

TABLE 1

| Developer Composition | | |
|---|---|---|
| | Concentration | |
| Component | Dev(1) | Dev(2) |
| AC5 | 0.6 g/l | 0.6 g/l |
| DTPA | 0.81 g/l | 0.81 g/l |
| $K_2HPO_4.3H_2O$ | 40 g/l | 40 g/l |
| KBr | 1 mg/l | 1 mg/l |
| KCl | 0.5 g/l | 0.5 g/l |
| KOH (50%) | 10 ml/l | 10 ml/l |
| DEH | 1.0 ml/l | 1.0 ml/l |
| CD3 | 4.5 g/l | 10 g/l |
| pH | 11.4 | 11.4 |
| Temp | 35° C. | 35° C. |
| Time | 30 seconds | 30 seconds |

Where AC5 is a 60% solution of 1-hydroxyethylidene-1, 1-diphosphonic acid, DTPA is diethylenetriaminepentaacetic acid, DEH is an 85% solution of diethyl hydroxylamine and CD3 is N-[2-(4-amino-N-ethyl-m-toluidino)ethyl]-methanesulfonamide sesquisulfate hydrate.

In order to determine if fixer compositions removed all the silver halide from a developed strip a diagnostic test in which a developer/amplifier was used after room light exposure as in the following process cycle.

| | |
|---|---|
| Develop | 30 seconds |
| Fix | 2 minutes |
| Wash | 2 minutes |
| Expose to room light | |
| Devamp | 45 seconds |
| Wash | 2 minutes |
| Dry | |

The developer/amplifier (devamp) had the following composition.

TABLE 2

| Developer/Amplifier Composition | |
|---|---|
| Component | Concentration |
| AC5 | 0.6 g/l |
| DTPA | 0.81 g/l |

TABLE 2-continued

| Developer/Amplifier Composition | |
|---|---|
| Component | Concentration |
| $K_2HPO_4.3H_2O$ | 40 g/l |
| KBr | 1 mg/l |
| KCl | 0.5 g/l |
| KOH (50%) | 10 ml |
| HAS | 1.0 g/l |
| CD3 | 4.5 g/l |
| pH | 11.4 |
| $H_2O_2$ (30% w/w) | 2.0 ml/l |
| Temp | 35° C. |
| Time | 45 seconds |

Some fixer compositions and process cycle variations were carried-out in order to establish a composition that would fix and which was also likely to be compatible with hydrogen peroxide. The paper used was a multilayer containing emulsions that were substantially pure silver chloride with a total silver content of about 64 mg/m$^2$.

TABLE 3

| Fixer Effectiveness | | | | | | | | | | |
|---|---|---|---|---|---|---|---|---|---|---|
| | | | | | Densities (× 100) | | | | | |
| | | | | Dev/ | Dmax | | | Dmin | | |
| Strip | Develop | Fix | Expose | amp | R | G | B | R | G | B |
| 0 | yes(1) | none | yes | yes | 269 | 264 | 255 | 268 | 262 | 255 |
| 1 | yes(1) | A | yes | yes | 269 | 262 | 253 | 18 | 32 | 129 |
| 2 | yes(1) | A | no | yes | 277 | 267 | 256 | 13 | 13 | 12 |
| 3 | yes(1) | B | no | yes | 270 | 271 | 254 | 14 | 14 | 15 |
| 4 | yes(1) | B | yes | yes | 277 | 263 | 256 | 11 | 12 | 13 |
| 10 | yes(1) | C | yes | yes | 276 | 265 | 246 | 11 | 14 | 13 |
| 24 | yes(1) | D | yes | yes | 259 | 265 | 255 | 13 | 17 | 32 |
| 25 | yes(1) | D | no | yes | 274 | 271 | 262 | 13 | 17 | 29 |
| 30 | yes(1) | E | yes | yes | 274 | 268 | 254 | 12 | 13 | 14 |
| 31 | yes(1) | F | yes | yes | 284 | 269 | 253 | 14 | 16 | 20 |

TABLE 4

| Fixer Compositions | | |
|---|---|---|
| Fixer | Components | Concentration |
| A | AC8 | 50 ml/l |
| B | AC8 | 50 ml/l |
| | DEA | 50 ml/l |
| C | AC8 | 50 ml/l |
| | DEA | 50 ml/l |
| | pH | 9.0 with acetic acid |
| D | AC8 | 50 ml/l |
| | DTOD | 1.0 g/l |
| E | AC8 | 50 ml/l |
| | DTOD | 0.1 g/l |
| F | NTA | 10 g/l |
| | DTOD | 0.1 g/l |

Where AC8 is a 40% solution of the pentasodium salt of diethylenetriaminepentaacetic acid, DEA is diethanolamine, DTOD is dithiaoctane diol, NTA is nitrilotriacetic acid.

It can be seen that when there is no fixing the Dmin density is about the same as the Dmax density thus the method is a sensitive test for the effectiveness of the fixer bath. Strip 1 shows that fixer A fixes the top two layers quite well but only partially fixes the bottom or yellow layer. If the expose step is omitted as in strip 2 then normal Dmin densities are obtained. Strip 3 shows the effect of adding a fixing accelerator, diethanolamine, to AC8 to make fixer B.

-continued

| Amplifier/Bleach/fix (G) | |
|---|---|
| $H_2O_2$ (30% w/w) | 50 ml/l |
| Acetic acid to | pH 9.0 |

Strips were processed according to the above process cycle and the results are shown in Table 5 below.

TABLE 5

| | Amplifier/Bleach/Fixers | | | | | | | | | |
|---|---|---|---|---|---|---|---|---|---|---|
| | | | | | Densities (× 100) | | | | | |
| | | | | | Dmax | | | Dmin | | |
| Strip | develop | ABF | expose | devamp | R | G | B | R | G | B |
| 8 | yes(1) | none | no | no | 67 | 74 | 78 | 10 | 10 | 8 |
| 8a | yes(1) | none | no | yes | 275 | 258 | 251 | 14 | 13 | 12 |
| 11 | yes(1) | G(2') | yes | yes | 159 | 145 | 134 | 12 | 14 | 15 |
| 12 | yes(1) | G(1') | yes | yes | 144 | 140 | 133 | 12 | 15 | 15 |
| 13 | yes(1) | G(1') | yes | no | 151 | 143 | 136 | 13 | 14 | 14 |
| 53 | yes(2) | G(1') | no | no | 214 | 216 | 183 | 13 | 13 | 15 |
| 54 | yes(2) | G(1') | yes | yes | 207 | 229 | 189 | 13 | 13 | 15 |

Now it can be seen with strips 3 and 4 that normal Dmin densities are obtained with or without exposure before the devamp stage. This indicates complete fixing in 2 min in fixer B. Strip 10 shows that fixer C that is the same as fixer B except that the pH has been adjusted to 9.0 with acetic acid also fixes completely in 2 min. Strip 24 shows that another fixer accelerator DTOD gives almost complete fixing although the yellow Dmin is somewhat high. Strip 25 is a repeat of 24 but now without any expose step after fixing and yet the same slightly high yellow Dmin is obtained. This shows that the Dmin is not due to incomplete fixing but to some fogging action of DTOD. If the level of DTOD if lowered as in fixer E then this fogging is not present and fixing is complete. Fixer F shows that another amino carboxylic acid, NTA, also acts as a fixing agent in combination with DTOD. It appears for the purposes of making an amplifier/bleach/fixer that fixers B or C would be suitable and this is illustrated in example 2.

EXAMPLE 2

In this example hydrogen peroxide is added to the fixer in order to convert it to a fixer that will also amplify and bleach. A process cycle was carried out as follows:

| | |
|---|---|
| Develop | 30 sec |
| Amplify/fix | 1–2 min |
| wash | 2 min |
| expose to room light | |
| devamp | 45 sec |
| fix | 1 min |
| wash | 2 min |

where fix is a standard Kodak fixer.

An amplifier/bleach/fixer(ABF) of the composition shown below was made up;

| Amplifier/Bleach/fix (G) | |
|---|---|
| AC8 | 50 ml/l |
| DEA | 50 ml/l |

Where G(1') means 1 minute immersion in the amplifier/bleach/fix(G).

These data show that all three operations have occurred in the amplifier/bleach/fix step. The increase in density of 11, 12 and 13 compared with 8 indicates amplification. Full Dmax is not achieved because the CD3 level in developer(1) needs to be higher for this to occur as shown with strip 53 that used developer(2) with 10 g/l CD3. The low Dmax in the first part is intentional in this experiment because an intermediate Dmax density will be increased to show if bleaching has or has not occurred. This is because the devamp amplifies on the unbleached silver as shown by comparing the Dmax densities of strips 8 and 8a. The fact that strips 12 and 13 are almost the same Dmax density means that no amplification has occurred at the devamp stage with strip 12 and so there is no silver or silver halide in the Dmax areas and so bleaching (and fixing) must have occurred. This is confirmed by comparison with the strip 8a that was not bleached or fixed and the Dmax density is now much higher and about the same as the samples which were fixed but not bleached in table 3 in example 1. Finally there is no increase in the Dmin of 12 compared with 13 indicating that all the silver halide has been fixed.

The invention has been described in detail with particular reference to preferred embodiments thereof, but it will be understood that variations and modifications can be effected within the spirit and scope of the invention.

I claim:

1. A method for processing comprising:

A) color developing a photographic silver halide color material comprising two or more silver halide layers sensitized to different regions of the visible spectrum having associated therewith appropriate dye image forming couplers, and B) treating said color developed material with an amplifier/bleach/fix solution comprising:

a redox oxidant that is capable of bleaching a silver image, a fixing agent that does not poison the catalytic properties of s aid silver image, and that does not react with said redox oxidant, said fixing agent being present in an amount of from 10 to 100 g/l, and a fixing accelerator in an amount of from 0.01 to 150 g/l.

2. The method of claim 1 wherein said fixing agent is a polycarboxylic amino acid.

3. The method of claim 1 wherein said fixing agent is a compound having at least one:

$$N—[(CH_2)_n—A]_p$$

moiety wherein A is —COOH or —$PO_3H_2$, n is 1 to 6 and p is 1 to 3 provided that the compound contains at least 2 A groups.

4. The method of claim 3 wherein said fixing agent is:

ethylenediaminetetraacetic acid (EDTA), propylenediaminetetraacetic acid, 2-hydroxy-1,3-propylenediaminetetraacetic acid, diethylenetriaminepentaacetic acid, nitrilotriacetic acid, ethylenediaminetetramethylene phosphonic acid, diethylenetriaminepentamethylene phosphonic acid, cyclohexylenediaminetetraacetic acid,

[(Ethylenedioxy)diethylenedinitrilo] tetra acetic acid, or ethylenedinitrilo-N,N'-bis(2-hydroxybenzyl)-N,N'-diacetic acid.

5. The method of claim 1 wherein said redox oxidant is hydrogen peroxide or a compound that provides hydrogen peroxide.

6. The method of claim 5 wherein hydrogen peroxide is present in an amount of from 0.1 to 150 ml/l as a 30% w/w solution.

7. The method of claim 1 wherein said fixing accelerator is a primary, secondary, or tertiary alkylamine, an alkyl diamine, triamine, tetramine, pentamine or hexamine, a cyclic polyamine, an aryl amine, a mono, di, or tri-alkanolamine, a thioether, a thioamine, or morpholine.

8. The method of claim 1 carried out by passing said material through a tank containing a processing solution that is recirculated through said tank at a rate of from 0.1 to 10 tank volumes per minute.

9. The method of claim 8 wherein the ratio of tank volume to maximum area of photographic material accommodatable therein is less than 11 $dm^3/m^2$.

10. The method of claim 6 wherein hydrogen peroxide is present in an amount of from 10 to 50 ml/l as a 30% w/w solution.

11. The method of claim 1 wherein said amplifier/bleach/fix solution has a pH of from about 8 to about 10.

12. The method of claim 1 wherein said fixing accelerator is present in an amount of from 0.1 to 80 g/l.

13. The method of claim 1 wherein said photographic silver halide color material is a silver chloride color paper having a silver halide emulsion having at least 85 mol % silver chloride, and a total silver coverage of less than 130 $mg/m^2$.

14. The method of claim 13 wherein said photographic silver halide color material has a total silver coverage of from 25 to 120 $Mg/M^2$.

15. The method of claim 13 wherein said photographic silver halide color material has a blue sensitive silver halide emulsion layer unit comprising 20 to 60 $Mg/m^2$.

16. The method of claim 1 wherein said redox oxidant is hydrogen peroxide, a compound that provides hydrogen, a cobalt (III) complex, or a periodate.

* * * * *